US008458832B1

(12) United States Patent
Krishna

(10) Patent No.: US 8,458,832 B1
(45) Date of Patent: Jun. 11, 2013

(54) DUVET

(76) Inventor: Shirley Krishna, Coolaroo (AU)

( * ) Notice: Subject to any disclaimer, the term of this patent is extended or adjusted under 35 U.S.C. 154(b) by 0 days.

(21) Appl. No.: 13/385,852

(22) Filed: Mar. 12, 2012

(51) Int. Cl.
*A47G 9/02* (2006.01)

(52) U.S. Cl.
USPC ..... 5/501; 5/502

(58) Field of Classification Search
USPC ..... 5/501, 502, 482
See application file for complete search history.

(56) References Cited

U.S. PATENT DOCUMENTS

| | | | | |
|---|---|---|---|---|
| 2,505,027 | A * | 4/1950 | Belsky | 5/501 |
| 2,637,860 | A * | 5/1953 | Lehigh | 5/502 |
| 3,008,152 | A * | 11/1961 | Seidenberg | 5/501 |
| 7,013,509 | B2 * | 3/2006 | Hickman | 5/485 |
| 7,181,790 | B2 * | 2/2007 | Wirtz | 5/501 |
| 7,228,578 | B2 * | 6/2007 | Linnane | 5/485 |
| 2011/0314605 | A1 * | 12/2011 | Deguchi | 5/501 |

* cited by examiner

*Primary Examiner* — Michael Trettel

(57) ABSTRACT

A novel duvet having two or more sealable side edges, wherein the inside corners of the duvet may further comprise a clip to hold the comforter in place.

2 Claims, 2 Drawing Sheets

(Open View)

(Semi-Open View)

(Open View)

(Semi-Open View)

(Closed View)

DUVET

DESCRIPTION OF PREFERRED EMBODIMENTS

Figure 1:
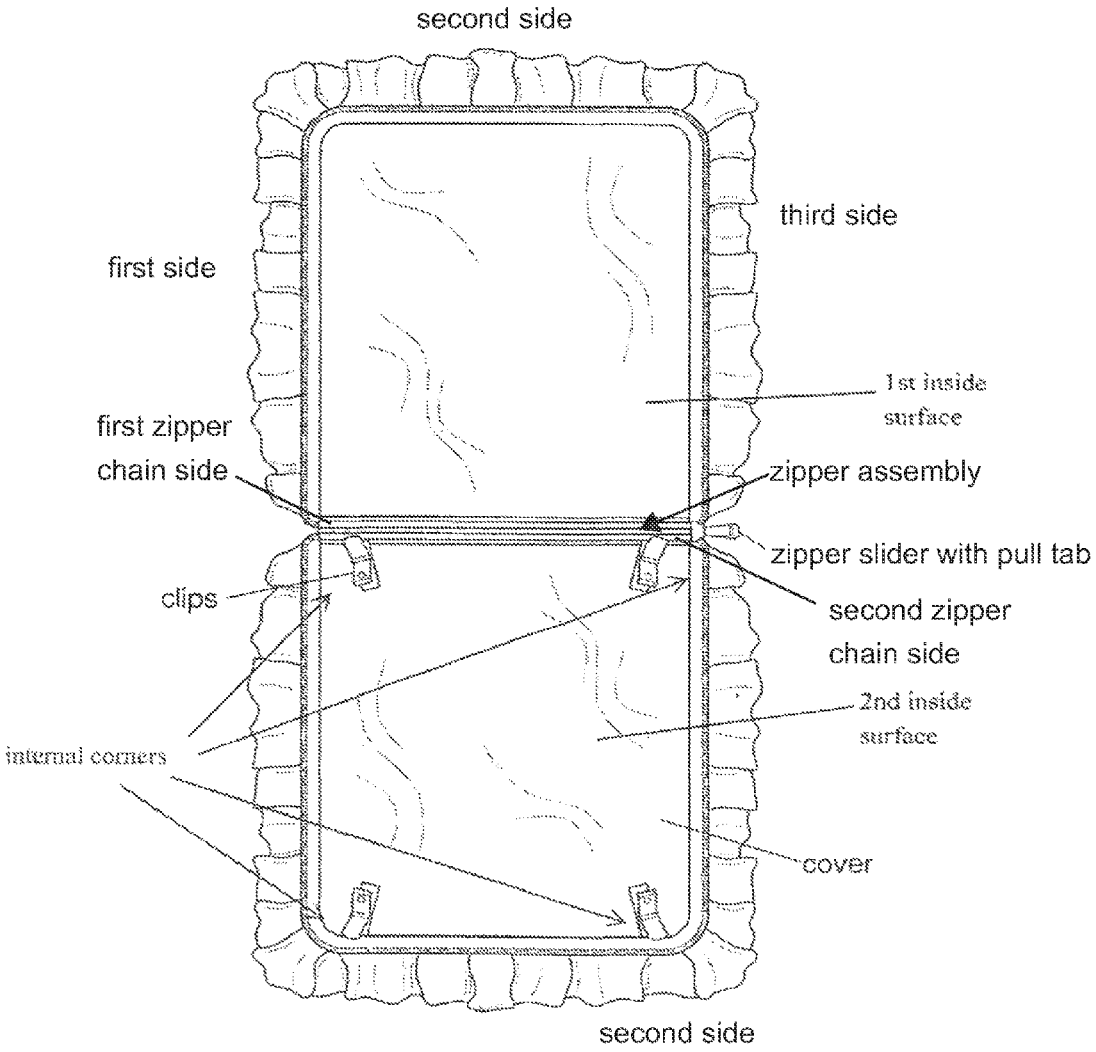
FIG. 1 shows an exemplary inside view of a duvet with zippers on three sides of four side edges, and clips disposed at each internal corner.
Figure 2:
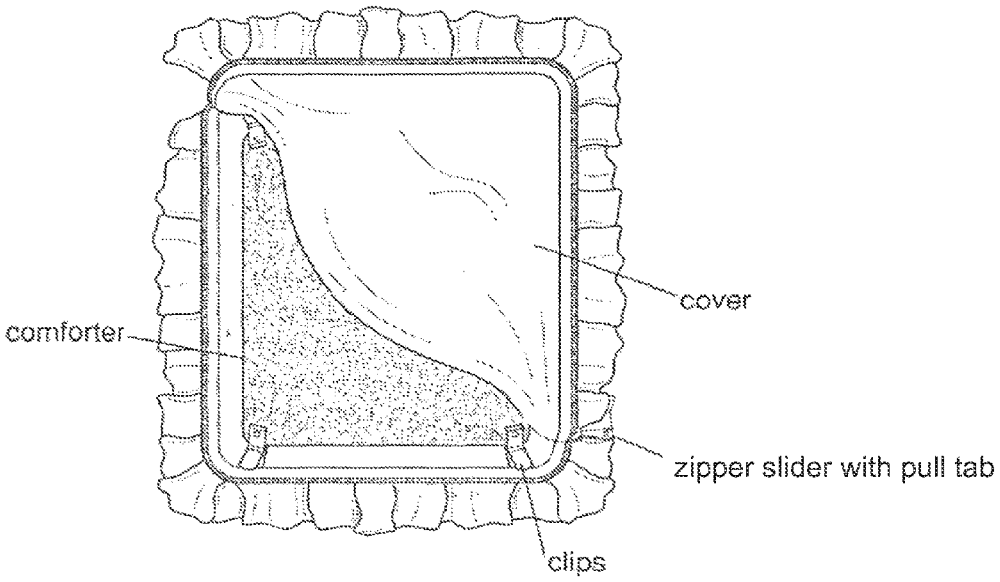
FIG. 2 shows an exemplary duvet with a comforter clipped inside.
Figure 3:
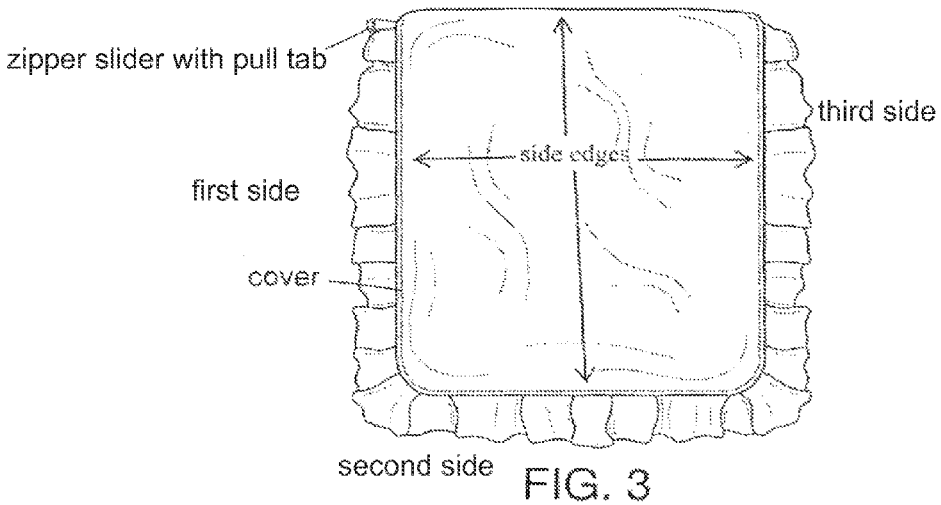
FIG. 3 shows an exemplary duvet with the three sides zipped up.

Referring now to FIGS. 1-3, the present invention features a duvet comprising four side edges, where at least three of the side edges are temporarily secured together via an attachment means, hereinafter "sealable side edges". In some embodiments, the sealable side edges comprises a first side edge, a second side edge, and a third side edge. In some embodiments, the duvet is adapted to be folded making a folded side edge. In some embodiments, the first inside surface faces the second inside surface. In some embodiments, the present invention features a zipper assembly having a first zipper chain side, a second zipper chain side, and a zipper slider with pull tab. In some embodiments, the folded side edge is not detachable. In some embodiments, the first zipper chain side is continuously disposed on a first side edge, a second side edge, and a third side edge each disposed on the first inside surface. In some embodiments, the second zipper chain side is continuously disposed on a first side edge, a second side edge, and a third side edge each disposed on the second inside surface. In some embodiments, the zipper assembly engages and joins the first zipper chain side to the second zipper chain side. In some embodiments, the first side edge of the first inside surface is joined to the first side edge of the second inside surface. In some embodiments, the second side edge of the first inside surface is joined to the second side edge of the second inside surface. In some embodiments, the third side edge of the first inside surface is joined to the third side edge of the second inside surface. In some embodiments, the zipper assembly originates at a first end of the folded side edge and runs continuously across the first side edge, the second side edge, and the third side edge of the duvet. In some embodiments, the zipper assembly terminates at a second end of the folded side edge. In some embodiments, the duvet further comprises four internal corners, a first inside surface and a second inside surface. The attachment means include zipper, buttons, hook-and-loop devices (Velcro®) and the like.

In some embodiments, the sealable side edges are adjacent to each other. In some embodiments, the sealable side edges are on opposite sides of each other. In some embodiments, three of the four side edges are sealable side edges, see for example FIG. 1.

In some embodiments, a clip is located near one of the four internal corners. The clip is for holding a comforter in place. In some embodiments, a clip is located near two of the four internal corners. In some embodiments, a clip is located near three of the four internal corners. In some embodiments, a clip is located near all four of the internal corners, see for example FIG. 1. The clip could be made of a metal or plastic or a combination of plastic and metal components, silicone, or any other suitable materials. In some embodiments, a clip is permanently sewn into a side edge close to but not into each of the four internal corners, thus comprising four clips. In some embodiments, two clips are permanently sewn into one of the side edges and two clips are permanently sewn into the opposing side edge. In some embodiments, the remaining two side edges comprise no clips sewn therein. In some embodiments, a comforter is located in the duvet, interfacing with the first inside surface and the second inside surface. In some embodiments each clip is attached to a side edge of the comforter. In some embodiments, a border is located around the comforter between the side edges of the comforter and each of the four side edges of the duvet.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A duvet comprising four side edges, wherein three of the side edges, hereinafter referred to as a first side edge, a second side edge, and a third side edge, are temporarily secured together via a zipper assembly having a first zipper chain side, a second zipper chain side, and a zipper slider with pull tab, wherein the duvet is adapted to be folded making a folded side edge, wherein the folded side edge is not detachable, wherein a first inside surface faces a second inside surface, wherein the first zipper chain side is continuously disposed on a first side edge, a second side edge, and a third side edge each disposed on the first inside surface, wherein the second zipper chain side is continuously disposed on a first side edge, a second side edge, and a third side edge each disposed on the second inside surface, wherein the zipper assembly engages and joins the first zipper chain side to the second zipper chain side, wherein the first side edge of the first inside surface is joined to the first side edge of the second inside surface, wherein the second side edge of the first inside surface is joined to the second side edge of the second inside surface, wherein the third side edge of the first inside surface is joined to the third side edge of the second inside surface, wherein the zipper assembly originates at a first end of the folded side edge and runs continuously across the first side edge, the second side edge, and the third side edge of the duvet, wherein the zipper assembly terminates at a second end of the folded side edge, wherein the duvet comprises four internal corners, wherein a clip is permanently sewn into a side edge proximal to each of the four internal corners, thus comprising four clips, wherein two clips are permanently sewn into one of the side edges and two clips are permanently sewn into the opposing side edge, wherein the remaining two side edges comprise no clips sewn therein, wherein a comforter is disposed in the duvet, interfacing with the first inside surface and the second inside surface, wherein each clip is attached to a side edge of the comforter, wherein a border is disposed around the comforter between the comforter and each of the four side edges of the duvet.

2. A duvet consisting of four side edges, wherein three of the side edges, hereinafter referred to as a first side edge, a second side edge, and a third side edge, are temporarily secured together via a zipper assembly having a first zipper chain side, a second zipper chain side, and a zipper slider with pull tab, wherein the duvet is adapted to be folded making a folded side edge, wherein the folded side edge is not detachable, wherein a first inside surface faces a second inside surface, wherein the first zipper chain side is continuously disposed on a first side edge, a second side edge, and a third side edge each disposed on the first inside surface, wherein the second zipper chain side is continuously disposed on a first side edge, a second side edge, and a third side edge each disposed on the second inside surface, wherein the zipper assembly engages and joins the first zipper chain side to the second zipper chain side, wherein the first side edge of the first inside surface is joined to the first side edge of the second inside surface, wherein the second side edge of the first inside surface is joined to the second side edge of the second inside surface, wherein the third side edge of the first inside surface is joined to the third side edge of the second inside surface, wherein the zipper assembly originates at a first end of the folded side edge and runs continuously across the first side edge the second side edge, and the third side edge of the duvet, wherein the zipper assembly terminates at a second end of the folded side edge, wherein the duvet consists of four internal corners, wherein a clip is permanently sewn into a side edge proximal to each of the four internal corners, thus consisting of four clips, wherein two clips are permanently sewn into one of the side edges and two clips are permanently sewn into the opposing side edge, wherein the remaining two side edges consist of no clips sewn therein, wherein a comforter is disposed in the duvet, interfacing with the first inside surface and the second inside surface, wherein each clip is attached to a side edge of the comforter, wherein a border is disposed around the comforter between the comforter and each of the four side edges of the duvet,

* * * * *